United States Patent [19]

Kössler

[11] 4,094,241

[45] June 13, 1978

[54] PERFORATED DOCTOR ROLL

[76] Inventor: Edgar Kössler, Schachterlweg 24/52, A-9020 Klagenfurt, Austria

[21] Appl. No.: 716,687

[22] Filed: Aug. 23, 1976

[30] Foreign Application Priority Data

Aug. 29, 1975 Austria ..... 6665/75

[51] Int. Cl.[2] ..... B41F 15/44

[52] U.S. Cl. ..... 101/120; 118/406; 118/414

[58] Field of Search ..... 101/119, 120, 116, 367, 101/331; 29/121.1, 121.3; 118/406, 414, 244, 258

[56] References Cited

U.S. PATENT DOCUMENTS

| | | | |
|---|---|---|---|
| 3,718,117 | 2/1973 | Lewicki, Jr. | 118/414 |
| 3,845,712 | 11/1974 | Lewicki, Jr. | 101/120 X |
| 3,965,817 | 6/1976 | Ipek | 101/120 |

FOREIGN PATENT DOCUMENTS

| | | | |
|---|---|---|---|
| 2,101,085 | 10/1971 | Germany | 101/120 |
| 772,711 | 4/1957 | United Kingdom | 101/120 |

*Primary Examiner*—Ronald E. Suter
*Attorney, Agent, or Firm*—Haseltine, Lake & Waters

[57] ABSTRACT

A doctor roll arrangement, especially for stencil printing, comprising a hollow tube rollable on a support, the tube being provided with gaps through which part of a supply of an inking substance can enter into the interior of the tube, the supply being normally placed in front of the tube. The arrangement may include an internal doctor that is fitted into the tube, and being preferably adapted to revolve. The internal doctor may be constructed as a magnetic roller that can be attracted by a magnetic body. In accordance with the invention, the internal doctor can also be constructed as a perforated, hollow tube. Furthermore, a further magnetic roller can be fitted in the perforated tube, acting as a further internal doctor. Finally, at least one of the hollow tubes, the internal doctor, and the further internal doctor can consist of a magnetizable material that can be attracted by the magnetic body.

2 Claims, 7 Drawing Figures

PERFORATED DOCTOR ROLL

BACKGROUND OF THE INVENTION

The invention is concerned with a doctor roll arrangement comprising a tube revolving on its bedplate, especially for stencil printing.

Doctors in the form of blades or rolls are used for forcing ink through the spaces or fine openings of flat or circular stencils, but also for direct application of viscous compositions onto a surface to be treated, for example the top surface of a moving web.

When using a doctor roll within a silk-screen printing stencil, the intensity of color supplied, per unit of area, to the parts of the web to be printed on depends on the diameter of the doctor roll, the contact pressure thereof, and the viscosity of the color supply. Conditions are similar with doctor rolls that do not work in stencils but apply a viscous mass directly onto the surface to be treated.

Tubular doctors are known for some time (cf. U.S. Pat. No. 2,419,695). They have the advantage that their diameter can be made quite large compared with a solid roll of the same mass. A large roll diameter demands, however, high pressure on that portion of the inking substance that enters a wedge-shaped gap between the doctor roll and the surface on which it rolls. Such a higher pressure leads directly to the deposition of larger quantities of color in stencil printing and the length of the wedge-shaped gap promotes bleeding.

However, in a flat doctor gap only a very limited quantity of ink can enter, and it follows that a narrow limit has hitherto been placed on the augmentation of the ink deposit by use of a tubular doctor. It has now surprisingly been discovered that the ink deposit can be substantially increased if, in accordance with the invention, in the case of a tubular doctor roll, the roll is provided with recesses or gaps through which ink quantities to be deposited can enter from a stock or supply located in front of the tube, to be pressed into the interior of the tube.

SUMMARY OF THE INVENTION

The mechanism providing this suprising result has not yet been entirely explored. It has, however, been established that color from the region of the wedge of ink lying in front of the doctor roll finds its way inside the roll, and obviously flows toward the line of contact of the doctor roll with its bed, probably directly behind same, and partly onto the treated web. However, by a judicious adjustment of the ink viscosity and the size of the doctor roll gaps — based of course on the surface tension of the ink — no trickling takes place in the region behind the printing area.

A further decisive increase in the observed effect appears if an inside doctor, designed preferably as a doctor roll, is additionally fitted within the tube.

In such case two stocks or supplies of ink are formed, namely in front of the main doctor roll and inside same, in front of the internal doctor. In the printing process, in both the circular or the flat stencil in use and in the gaps of the doctor roll, drainage occurs which together with the formation of two ink wedges leads to a substantial augmentation of inking.

Further objects, important inventive features, and advantages of the novel doctor roll arrangement will become better understood by reference to the following detailed description when taken in conjunction with the accompanying drawings, wherein

IN THE DRAWINGS

PREFERRED EMBODIMENT

Figure 1:
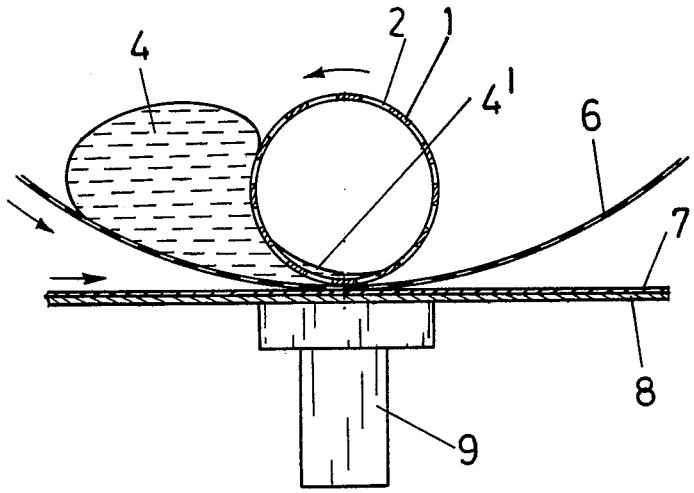
FIGS. 1 through 5 are schematic cross sections through different inking attachments provided with doctor rolls and arrangements in accordance with the invention.

An inking device or arrangement is illustrated in FIG. 1, comprising a doctor roll is constructed as an intrinsically rigid, hollow tube 1 revolving on the inside of a curved stencil 6. Tight contact of tube 1 onto stencil 6 is insured in the present case by means of a magnetic body 9, for which purpose tube 1 is made of magnetizable material such as nickel. Contact could also be made equally well by known mechanical or compressed-air means (not shown).

Ink feed is provided in front of tube 1 (toward the lefthand side of the drawing), on which account a supply of ink 4 is formed between same and stencil 6, continuing in the form of a wedge, somewhat of a drop shape, into the space between tube 1 and stencil 6.

As tube 1 is provided with gaps or clearances 2, ink 4, when the device is in operation, is not only squeezed from stock 4 onto web 7 carried on a machine blanket 8, but also a small stock of ink 4' is built up in the interior of tube 1. This results in an additional supply of ink arriving onto web 7 in the direct field of contact of tube 1 and stencil 6.

Various options are available with regard to the size and arrangement of the gaps 2 distributed uniformly over the whole surface of tube 1. Inking volume naturally increases according to the number and diameter of gaps 2, the gap diameter must not however be so large, with a given viscosity of ink in use, for any of the ink in the area behind tube 1 to drip onto stencil 6.

Figure 2:
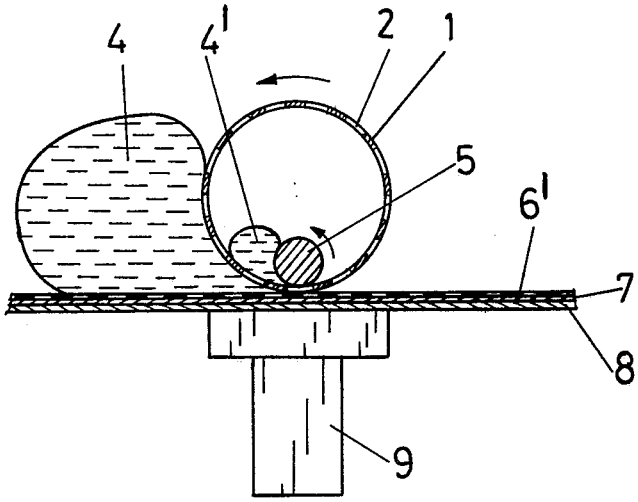

FIG. 2 differs from FIG. 1 chiefly in the fitting of an internal doctor in the form of a magnetic roll 5 made from magnetizable material. In this arrangement both stocks of ink 4 and 4' lead to the formation of ink wedges, as shown. The contact pressure of magnetic roll 5, which is pressed against the inside of tube 1 by magnetic body 9, affects first and foremost the impression depth of ink; there is, however, no simple relationship here, since for example with high nap or crepe fabrics the best print penetration is obtained with slight contact.

The second embodiment of FIG. 2 differs furthermore from that according to FIG. 1 also because the stencil is constructed as a flat stencil 6'. Here the invention results in the advantage that ink stock 4 that exists in front of tube 1, at the end of the movement of the doctor, can proceed through gaps 2 of tube 1 onto the side of same lying there on the return movement.

Figure 3:
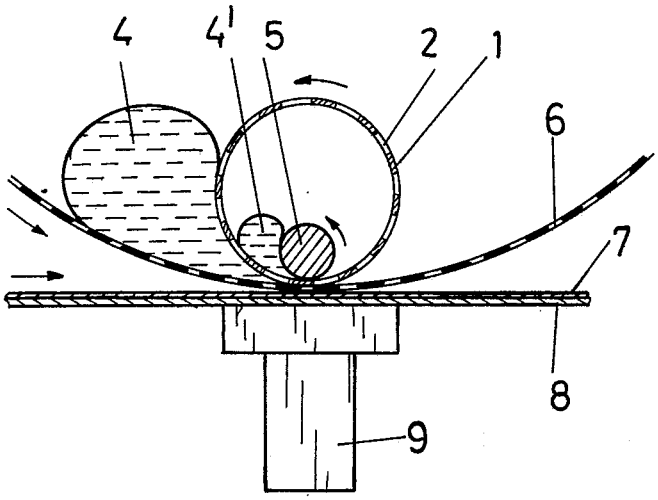

FIG. 3 corresponds to the previous embodiments except for the use of a curved stencil 6, as in FIG. 1. Otherwise, the arrangement is similar to that of FIG. 2.

Figure 4:
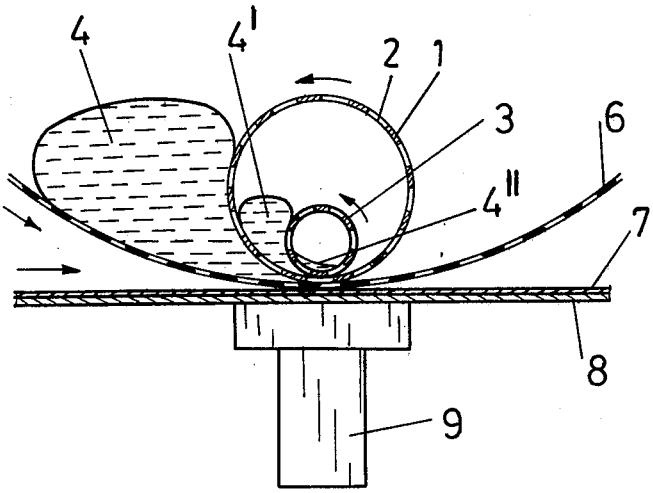

In a further arrangement, shown in FIG. 4, the internal doctor itself is a perforated hollow tube 1 which thus reinforces the effect due to the invention. There is formed here in the interior of tube 1 both a wedge-shaped ink stock 4' and also an ink stock 4'' that is not under pressure, from which, just as in FIG. 1, only ink suction occurs. Suction is caused by slackening of the web 7 when leaving the coating penetration area. The resultant opening of the pores of the web 7 cause suction of the ink which is in the internal doctor 5.

Figure 5:
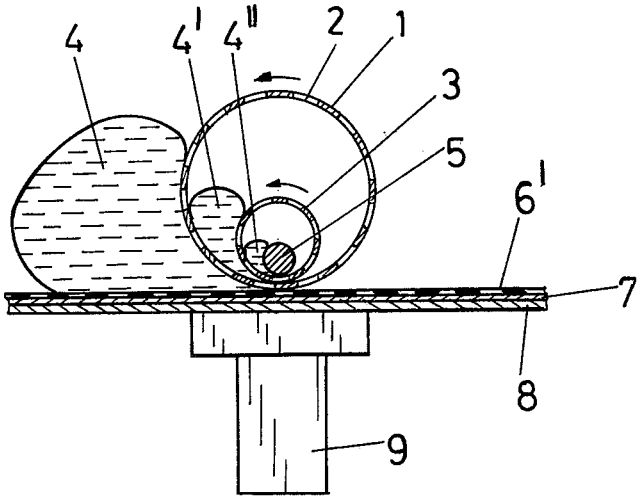

Against FIG. 4, the additional fitting of a magnetic roll 5, as shown in the arrangement of FIG. 5, does not lead to any substantial increase of the amount of inking, but it does give an amplified depth of impression.

As mentioned, the dimensions of tube 1, the size of gaps 2, and the number of holes per unit of area can be varied within comparatively broad limits.

Figure 6:
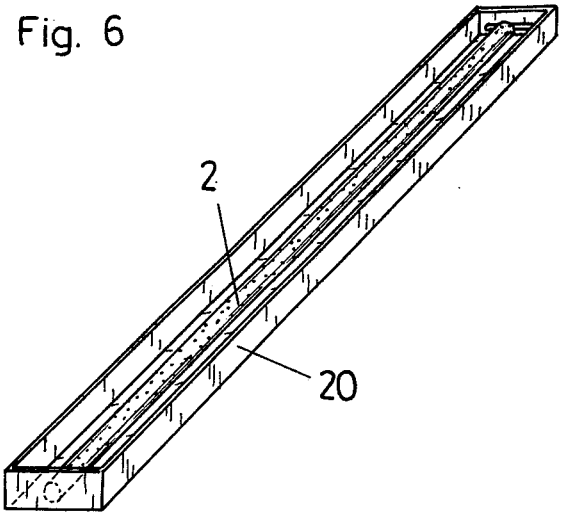
FIGS. 6 is a perspective view of a doctor roll according to the invention, inside an ink trough.
Figure 7:
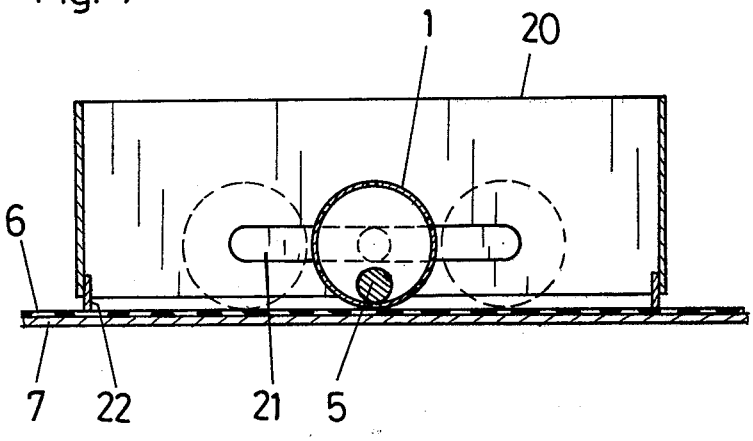
FIG. 7 is a cross section of the appliance of FIG. 6.

FIGS. 6, 7 illustrate a tube according to the invention (that is, to any one of the embodiments), lying in an ink trough 20. It is carried in guide grooves 21 bilaterally in each of the end walls of trough 20. The trough rests on the stencil over packing washers 22. It will be understood that FIG. 7 illustrates an internal arrangement similar to that of FIG. 2, but the ink-trough combination can of course make use of any of the inventive embodiments.

It should of course be understood that several additions, modifications and changes are possible from the described and illustrated exemplary embodiments which are considered to lie within the scope of the invention.

What I claim is:

1. An apparatus for applying ink to a substrate comprising: bearing means disposed beneath said substrate; a stencil having openings in the desired pattern arranged in superimposed relationship to said substrate; a doctor roll contacting said stencil under a positive contact pressure; a first ink supply located in front of said doctor roll, said doctor roll applying ink from said first ink supply through the openings of said stencil; wherein: said doctor roll being defined as a rigid hollow tube having a plurality of perforations about its periphery, said perforations being adapted to reduce hydrodynamic pressure in said first ink supply, whereby part of the ink from said first ink supply enters the interior of said rigid hollow tube through said perforations to form a second inner ink supply; said doctor roll being further defined by a rod-shaped member disposed in said hollow tube, said rod-shaped member providing a second internal doctor roll for said second ink supply.

2. An apparatus as claimed in claim 1, wherein: said rod-shaped member being defined as a second hollow tube.

* * * * *